US005419466A

United States Patent [19]

Scheindel

[11] Patent Number: 5,419,466

[45] Date of Patent: May 30, 1995

[54] BOWED PISTON FOR A PRESSURE OPERATED CONTAINER

[76] Inventor: Christian T. Scheindel, HCR 67 Box 45, Randolph Center, Vt. 05061

[21] Appl. No.: 197,002

[22] Filed: Feb. 15, 1994

Related U.S. Application Data

[63] Continuation of Ser. No. 940,544, Sep. 4, 1992, abandoned.

[51] Int. Cl.[6] ..... B67D 5/42

[52] U.S. Cl. ..... 222/389; 222/1; 222/386; 222/402.1

[58] Field of Search ..... 222/1, 130, 386, 386.5, 222/389, 402.1

[56] References Cited

U.S. PATENT DOCUMENTS

| | | | |
|---|---|---|---|
| 3,099,370 | 7/1963 | Hein | 222/386.5 |
| 3,132,570 | 5/1964 | Hoffman, Jr. et al. | 92/245 |
| 3,233,791 | 2/1966 | Miles | 222/389 |
| 3,255,936 | 6/1966 | Healy et al. | 222/389 |
| 3,282,473 | 11/1966 | Moore | 222/327 |
| 3,381,863 | 5/1968 | Towns | 222/386.5 |
| 3,407,974 | 10/1968 | Chmielowiec | 222/386.5 |
| 3,563,258 | 2/1971 | Hechler, IV | 137/1 |
| 3,827,607 | 8/1974 | Schultz | 222/389 |
| 3,901,410 | 8/1975 | Schultz | 222/153 |
| 3,915,352 | 10/1975 | Scheindel | 222/389 |
| 3,917,124 | 11/1975 | Kifer | 222/386 |
| 4,023,717 | 5/1977 | Schultz | 222/386.5 |
| 4,027,810 | 6/1977 | vanManen | 222/327 |
| 4,045,938 | 9/1977 | Hansen | 53/22 R |
| 4,106,674 | 8/1978 | Schultz | 222/386.5 |
| 4,134,523 | 1/1979 | Hansen et al. | 222/389 |
| 4,452,370 | 6/1984 | Langensiepen et al. | 222/93 |
| 4,556,156 | 12/1985 | Frutin | 222/386.5 |
| 4,913,323 | 4/1990 | Scheindel | 222/386 |
| 5,065,900 | 11/1991 | Scheindel | 222/1 |

FOREIGN PATENT DOCUMENTS

| | | | |
|---|---|---|---|
| 737289 | 6/1966 | Canada | 222/389 |
| 2241924 | 3/1973 | Germany | 222/389 |

*Primary Examiner*—Andres Kashnikow
*Assistant Examiner*—Joseph A. Kaufman
*Attorney, Agent, or Firm*—McAulay Fisher Nissen Goldberg & Kiel

[57] ABSTRACT

A bowed piston for a pressure operated container has a cylindrical sidewall including an outwardly projecting bowed portion which forms an arch engagable with a sidewall of the container. The bowed arch provides a flexible sealing surface against the sidewall which allows the piston to adapt to out-of-round, out-of-tolerance or dented containers without increasing surface friction and thus prevents the piston from binding within the container. The bowed portion flattens along a part of its length to adapt to these imperfections. Additionally, the bow allows the piston to tilt somewhat within the container without binding and maintains a very thin product film for lubrication as the piston moves upwardly in the container. Consequently, the inventive piston enhances successful utilization of such containers with various products, including those of low viscosity by minimizing binding and/or propellant blow-by in use.

12 Claims, 2 Drawing Sheets

BOWED PISTON FOR A PRESSURE OPERATED CONTAINER

This is a continuation of application Ser. No. 07/940,544, filed Sep. 4, 1992, now abandoned.

TECHNICAL FIELD

This invention relates to pressurized containers having a product and a pressurized propellant separated by a movable piston and more particularly to a piston having a bowed sidewall which provides enhanced sealing along the container wall.

BACKGROUND

Pressurized dispensing containers having compartments separated by a piston are well known. Product is contained in a first compartment having outlet means such as a valve, with a movable piston separating the first compartment from a second compartment within which a propellant is located. The piston prevents mixing of the propellant and product to avoid contamination or other detrimental effects to the product.

Under pressure of the propellant, the piston forces the product out of the container when the valve is actuated. The piston uses the product as a sealant between the container wall and piston, relying on close tolerances in manufacture to provide a minimum gap to minimize permeation of the propellant into the product. The piston cannot be tight with the container wall since it must be free to move. Typically pistons are rigid, including ridges or lips to wipe along the container sidewall.

Existing pistons experience problems due to the close tolerances required for the system to operate. If the gap is too large, a substantial amount of propellant may leak by the piston. If too small, the piston may bind and prevent product discharge, or buckle and allow the propellant to blow-by the piston. Even if the piston is made to close tolerances, the container diameter is such that it may be out-of-tolerance or the container may be out-of-round. Denting of the container is also a problem which must be considered as such dents may cause the piston to bind. Because of the close tolerances required, there is a fairly high failure rate among containers using conventional piston constructions.

SUMMARY OF THE INVENTION

It is an object of the present invention to provide a container having a piston which is adaptable to containers having varying tolerances.

It is a further object of the present invention to provide a piston which is easily manufactured in high volume with lower tolerance limits yet with a higher success rate for use in a pressure operated container.

These and other objects of the present invention are achieved by providing a container having a sidewall, top, bottom and outlet means and further comprising a piston disposed in the container and movable therein, the piston having a side wall with an outwardly projecting bowed portion for engaging the container side wall, the bow being of sufficient length to provide a flexible sealing surface against the sidewall.

Utilizing the present invention, a flexible surface is provided which adapts to imperfections in the container side wall without binding or allowing propellant blow-by. In essence, the bow acts like a spring, biasing the piston surface into contact with the sidewall yet being sufficiently resilient to collapse and ride over dents or provide a seal in out-of-round portions of the container. Thus, both the piston and container tolerances have a significantly reduced impact on container failure.

BRIEF DESCRIPTIONS OF THE DRAWINGS

DETAILED DESCRIPTION OF THE INVENTION

Figure 1:
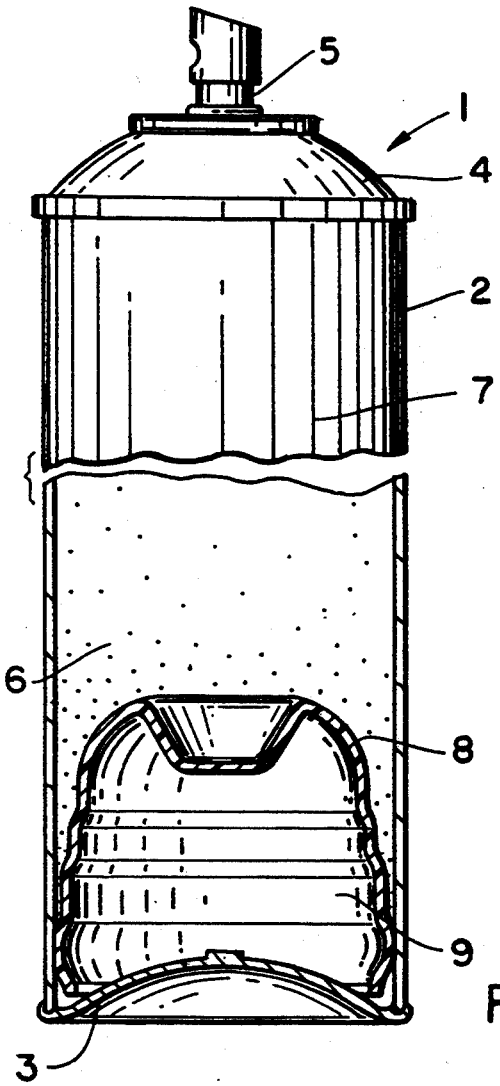
FIG. 1 is a cross sectional view of a container including the inventive bowed piston.

Referring to FIG. 1, a container 1 has a cylindrical side wall 2, a bottom 3 and a top 4. An outlet valve 5 is mounted on the top for dispensing a product 6 contained within a first compartment 7, defined by the top, sidewall and a piston 8. A second compartment 9 is defined by the bottom, sidewall and piston, and contains a propellant (not shown). The piston is movable within the container to force the product through the valve in response to the force of the pressurized propellant.

The container is of conventional construction, and may be of various sizes and shapes. The outlet valve may similarly be of any conventional construction. Any product or propellant capable of being dispensed from such a conventional container, of course, could be used with the present invention.

Figure 2:
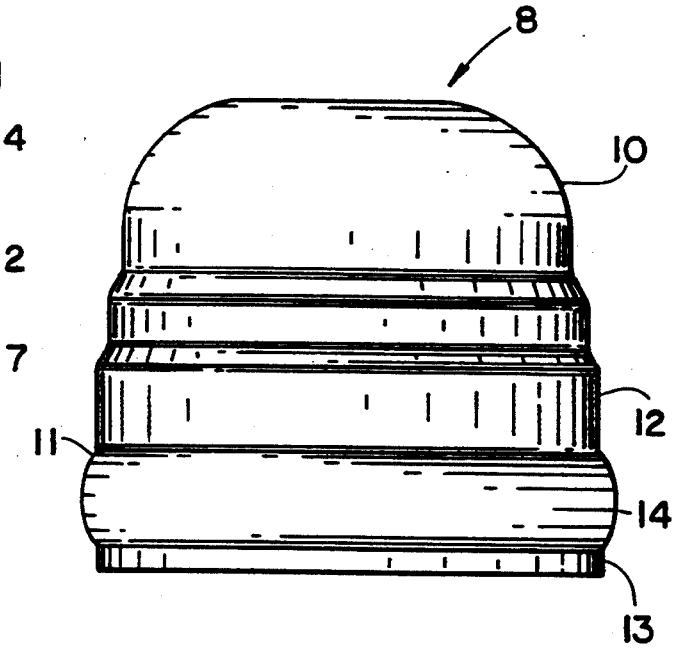
FIG. 2 is an enlarged view of the bowed piston of the invention.

Referring to FIG. 2 the piston 8 has a dome 10 shaped to fit the top of the container, and a side wall 11. The dome is shaped to fit the container top to maximize product evacuation. The sidewall has upper and lower skirt portions 12 and 13 respectively, and a bowed portion 14 defined therebetween. The bowed portion of the skirt is formed as an arch or concave shape, projecting outwardly from the piston sidewall. The bow is sized to have a peak diameter which provides a slight spacing to the container sidewall to an interference fit with the container. The bow is a flexible inwardly collapsible arch of sufficient length to assure adaption to sidewall defects, without binding.

Figure 3:
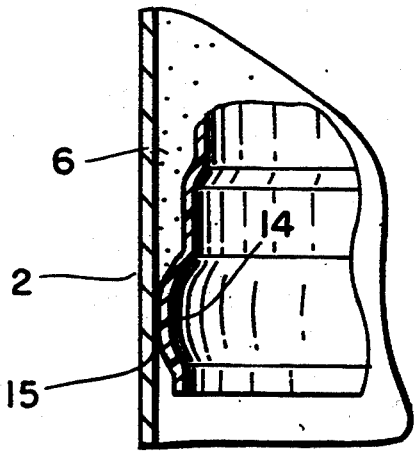
FIG. 3 is an enlarged sectional view of the seal achieved with the inventive piston.

Referring to FIG. 3, the bowed portion 14 forms a seal with the container sidewall 2. A thin film of product 15 acts as a lubricant between the bowed portion 14 and sidewall 2. In the area of contact, the bow is flattened across a portion of its length. The degree to which it is flattened depends on the tolerances between the piston and container. This assures a snug fit for sealing purposes to prevent product contamination or propellant blow-by. Yet, the bow shape allows the piston to adapt without binding. The bow shape acts like a spring, adding flexibility to an otherwise rigid piston structure.

Most pistons swell to some degree due to product absorption. With prior pistons, an increase in diameter due to swelling caused an increase in surface friction which resulted in binding or, in extreme cases, buckling which caused propellant blow-by. Such problems are avoided by the bowed piston of the invention since the piston adapts to the container, not by increasing diameter (and thus friction) along the sidewall, but by increasing the degree of flattening of the bowed portion.

The bowed portion may comprise the entire length of the sidewall or as little as one quarter of the sidewall length. Less than one quarter of the length provides reduced bow flexibility since it reduces the amount of area adaptable to flattening. In other words, the longer the arch, the better the flexibility. Thus, longer arch bows may be produced closer in diameter to the container sidewall diameter, and provide excellent sealing.

The piston may be made with a diameter ranging from some clearance to the container sidewall to an interference fit of a few thousandths without increasing surface friction regardless of swelling. Clearance may be provided of up to about 0.01 inch between the peak of the bow and the container sidewall to ease assembly into the container. A piston with a designed interference fit, of up to about 0.030 inch, may also be used as the degree of friction along the contacted surfaces is mitigated by the flexible adaption of the bow to the container.

Another advantage of the inventive piston is its ability to tilt within the container while maintaining a good seal.

Figure 4:
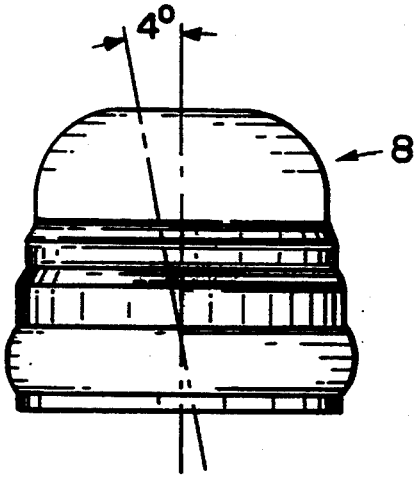
FIG. 4 is a view illustrating the degree of tilt acceptance of the inventive piston.
Figure 5:
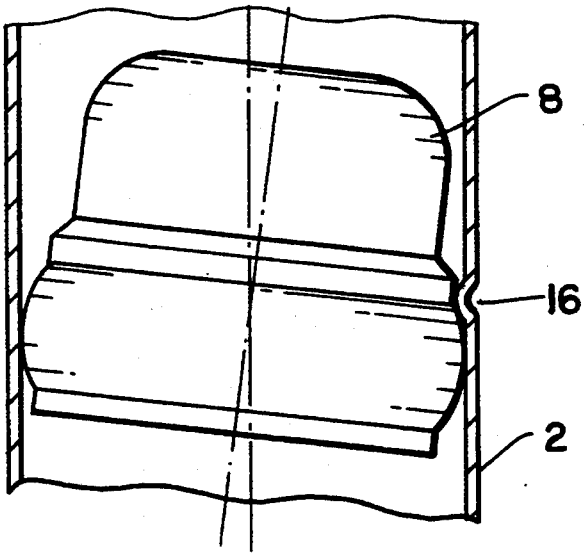
FIG. 5 is an exaggerated cross sectional view showing tilting of the inventive piston as it encounters a dent.
Figure 6:
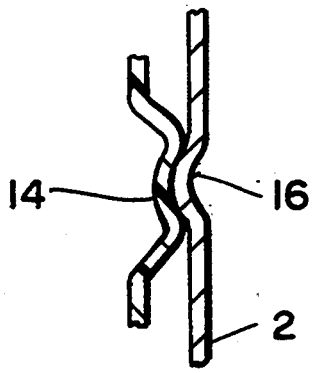
FIG. 6 is an enlarged view showing the bowed piston passing over a side wall dent.

Referring to FIGS. 4 and 5, the piston 8 has an acceptable angle of tilt of about 4°, without losing seal integrity. Such a tilt may occur, as shown in FIG. 5, due to an imperfection in the container sidewall such as dent 16. The tilt is accommodated by the flexible bowed portion by a lessening in the degree of flattening along one side of the piston, as shown in FIG. 5. This tilt would be accepted initially and then, the pressure would drive the bow over the dent through a contoured collapse as the flexible bow adapts to the shape of the dent, again without loss of seal integrity, as shown in FIG. 6.

Conventional containers have an inside diameter of 2.060 inches with a tolerance of +0.002/−0.001. For such a container, the bowed piston may have an upper and lower skirt diameter of 2.038", a peak bowed diameter of about 2.058", and a bow length of about 0.625" which is about ½ the sidewall length. The lower skirt diameter, being less than the container inner diameter, assists in inserting the piston in the container to ease assembly. This piston would have a clearance of 0.002", which would be taken up by piston swelling. The final thickness of the piston is typically from 0.010 to 0.020 mils though this is a matter of design choice.

An interference fit piston might have the same skirt diameter, but incorporate a bow peak diameter of 2.063" again with a length of about 0.625". Having a lower skirt diameter which is smaller than the container inner diameter allows, for the first time, a piston with an interference fit to be easily assembled into a container. Prior pistons lacked an integral flexible bowed portion, typically relying on a substantially rigid tapered sidewall with the largest diameter at the bottom. This made assembly into a container difficult with close tolerances and impossible with an interference fit.

Both the piston with clearance and the one with an interference fit require the product to act as a lubricant and seal along the container sidewall, the product forming a thin film on the container wall as the piston moves up within the container. It is known that such a film provides a path for propellant absorption by the product. With the inventive bowed piston, this film has an optimum minimized thinness to minimize propellant migration, as it maintains this thinness in out-of-round, out-of-tolerance and dented containers, which has never before been achieved. This is do to the substantially constant surface friction which is achieved by the flexible bow being flattened to varying degrees when in contact with the container sidewall.

This has led to another advantage over conventional containers. The bowed piston allows use of such piston containers with products of low viscosity previously never used before. Low viscosity products provide a poor seal and where the seal space may enlarge, would result in rapid migration of the propellant into the product. Since the inventive bowed piston minimizes this seal space, with substantially constant surface friction regardless of container tolerances, the potential for propellant migration is substantially reduced. Thus, the inventive piston expands the uses of such containers for dispensing products typically considered unusable. Viscosities as low as 80 centipoise have been successfully used with inventive bowed piston.

Figure 7:
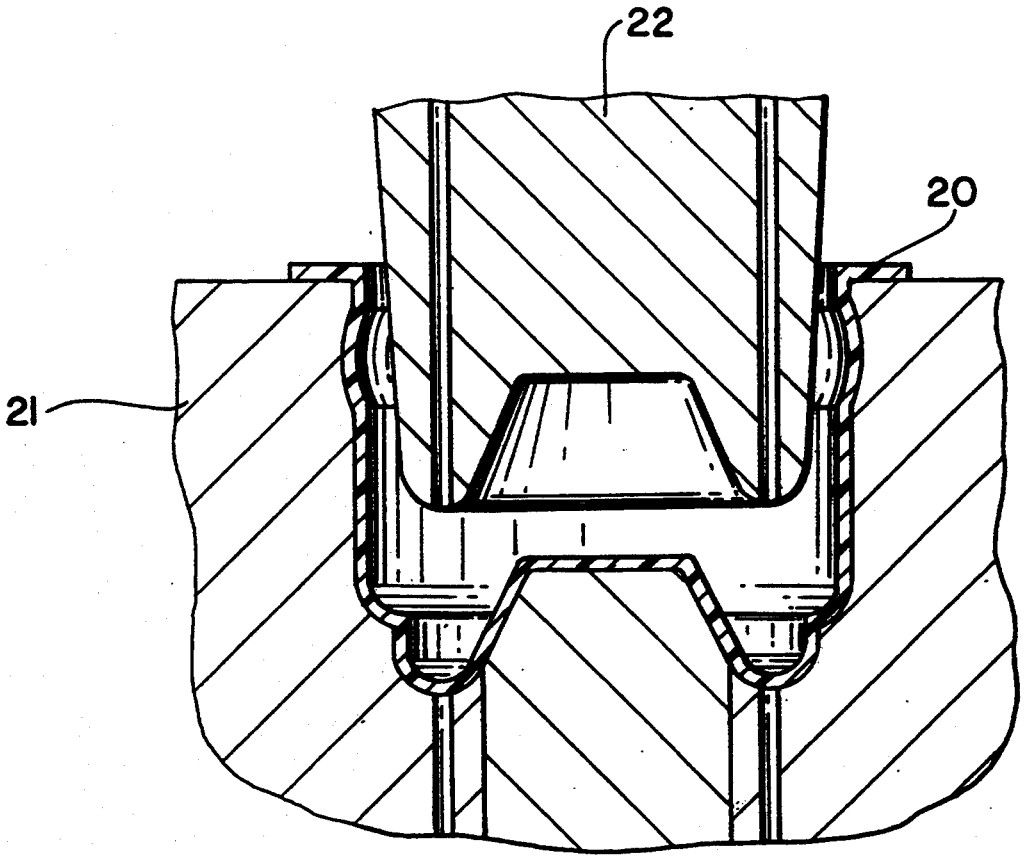
FIG. 7 shows the bowed piston being vacuum formed.

Preferably, the inventive piston is produced by thermo forming which allows use of multilayer materials having high barrier properties. This property assists in inhibiting permeation of the propellant gas directly through the piston into the product. Also, the thermoformed piston has the advantage of being produced with close tolerances. Since the bow is flexible, after thermoforming, the piston may be knocked out of the mold by switching the vacuum lines to add air pressure which ejects the piston from the mold. FIG. 7 shows a piston 20 in a vacuum mold 21 with a mold insert 22 partially removed. However, any process which produces a piston having the inventive bowed portion may be used, thermoforming being preferred.

The piston may be made of single or multilayered materials which incorporate a high permeation barrier material therein. Materials such as polypropylene/ethyl vinyl alcohol/polypropylene, polypropylene/polyvinylidene/polypropylene, polypropylene/nitrilepolymer/polypropylene, high density polyethylene/ethylvinylalcohol/high density polyethylene, single ply polyethylene, single ply acrylonitrile butadiene, single ply nylon, single ply nitrile polymer, or single ply high density polyethylene may be used. Of course, any other material suitable for use as a piston within a container can be used to produce the inventive bowed piston, and the invention is not limited to the listed materials.

Utilizing the present invention, the degree of tolerance required between the container and the piston can be more readily accommodated without causing binding, blow-by, or extensive gas migration. Additionally, the piston allows use with products formally considered unusable as it allows low viscosity materials to be discharged. Also, the piston allows for the incorporation of an interference fit yet allows easy assembly a the container.

While preferred embodiments of the present invention have been shown and described, it will be understood by those skilled in the art that various changes or modifications could be made without varying from the scope of the present invention. For example, while a piston containing a single bow has been shown and described, it will be understood by those skilled in the art that the incorporation of two or more bowed portions rather than a single bow may also be accommodated, and that other manufacturing processes other than thermo forming may be used to produce the inventive piston.

What is claimed is:

1. A piston for a container, the container having a sidewall, a product compartment and a propellant compartment, each compartment of the container separated by the piston, the piston being movable within the container and comprising:

a top portion for pushing a product within the container, and a cylindrical sidewall for sealing the product from a propellant, the cylindrical sidewall having a preformed outwardly projecting bowed portion relative to the cylindrical sidewall and slidable along the container sidewall, the bowed portion being collapsible inwardly when in contact with the container sidewall to provide a flexible sealing surface which flattens to a varying degree along the container sidewall to accommodate container and piston imperfections without increased frictional resistance to piston travel.

2. The piston of claim 1 wherein the bowed portion comprises 25 to 100% of the cylindrical sidewall.

3. The piston of claim 1 wherein the bowed portion comprises about 50% of the piston sidewall.

4. The piston of claim 1 wherein a peak of the outwardly projecting bowed portion is spaced away from the container sidewall by a slight gap.

5. The piston of claim 1 wherein a peak of the outwardly projecting bowed portion engages the container sidewall with an interference fit.

6. The piston of claim 1 further comprising a dome which is sized to enter the top of the container.

7. The piston of claim 1 wherein the piston sidewall has a lower skirt, disposed below the bowed portion.

8. The piston of claim 7 wherein the lower skirt has a diameter less than an inner diameter of the container.

9. The piston of claim 1 wherein the piston sidewall has an upper skirt provided above the bowed portion.

10. The piston of claim 9 wherein the upper skirt has a diameter less than the diameter of the container.

11. A container comprising a cylindrical sidewall, a bottom and a top, valve means disposed in the top for dispensing a product therefrom, a product disposable in a first compartment defined by the top, sidewall and a piston, a second compartment defined by the bottom, the sidewall and the piston, the piston movable within the container, the piston having a cylindrical sidewall for sealing the product from a propellant, a preformed outwardly projecting bowed portion slidable along the container sidewall, the bowed portion providing a flexible sealing surface which collapses inwardly when in contact with the container sidewall to a varying degree along the container sidewall to accommodate container and piston imperfections.

12. A method for dispensing a product from a container comprising:

providing a container having a sidewall, a bottom, a top, and valve means disposed in the top for dispensing the product from the container;

placing a piston in the container to provide a first compartment, defined by the top, container sidewall and piston for containing the product, and a second compartment, defined by the bottom, container sidewall and piston, for containing a propellant;

providing the piston with a cylindrical sidewall for sealing the product from the propellant, the piston cylindrical sidewall being slidable along the container sidewall and having a preformed outwardly projecting bowed portion relative to the piston cylindrical sidewall, the bowed portion being collapsible inwardly when in contact with the container sidewall to provide a flexible sealing surface which flattens to a varying degree along the container sidewall to accommodate container and piston imperfections without increased frictional resistance to piston travel;

loading a product into the first compartment;

loading a propellant into the second compartment; and opening the valve means to dispense the product as the piston is displaced in the container.

* * * * *